United States Patent [19]

Diederich

[11] 4,321,934

[45] Mar. 30, 1982

[54] GAS LIGHTER POWERED CURLING DEVICE

[75] Inventor: Walter J. Diederich, West Newbury, Mass.

[73] Assignee: The Gillette Company, Boston, Mass.

[21] Appl. No.: 230,835

[22] Filed: Feb. 2, 1981

[51] Int. Cl.[3] ..... A45D 2/24

[52] U.S. Cl. ..... 132/37 R

[58] Field of Search ..... 132/37 R

[56] References Cited

U.S. PATENT DOCUMENTS

| | | | |
|---|---|---|---|
| 2,492,636 | 12/1949 | Hendrickson | 132/37 R |
| 2,492,637 | 12/1949 | Hendrickson | 132/37 R |
| 2,589,510 | 3/1952 | Ratner et al. | 132/37 R |

*Primary Examiner*—G. E. McNeill

*Attorney, Agent, or Firm*—Raymond J. De Vellis

[57] ABSTRACT

A gas lighter provides a power source for a curling device, such as a curling iron or styling wand. The lighter is positioned and releasably retained in the hollow handle, in a first position. When the gas lighter is inserted further into the hollow handle in a second position, a valve actuating lever of the gas lighter is depressed to initiate fuel flow. Concomitantly, a flint wheel of the gas lighter is engaged and turned to cause the fuel to ignite. The lighter is held in place by a gripping position of a bi-metal member. When the temperature of a barrel of the curling device exceeds a predetermined amount, the gripping portion of the bi-metal member releases its hold on the gas lighter, and the lighter is allowed to return to the first position. In a preferred embodiment, the curling device is provided with a hair clip, which when raised from a hair winding portion of the barrel, trips the bi-metal member to release the gas lighter from the second position.

3 Claims, 8 Drawing Figures

38
39
45
44
42
40
43
46
15
14
17
16
18
20
19
21
26
25a
23
22
13a
27a
28
37
13c
36
13b
32
34
11
35

15
47
39
38
14
17
16
18
45
44
42
20
12
40
19
37
21
26
27a
28
13c
25a
36
13b
13a
32
11
34
35

GAS LIGHTER POWERED CURLING DEVICE

BACKGROUND OF THE INVENTION

This invention relates to a curling device such as a curling iron or styling wand. More particularly, this invention relates to a personal care appliance such as a curling device which is powered by a gas lighter.

A curling device powered by a gas lighter is described in U.S. Pat. No. 2,589,510. Such a device includes no automatic temperature control and may be used when a flame is present.

The present invention provides a curling device which overcomes the above difficulties by providing a curling device powered by a widely available gas lighter which operates in a safe, convenient manner.

SUMMARY OF THE INVENTION

It is an object of this invention to provide a curling device which is safely powered by a removable gas lighter.

It is another object of the invention to use a readily available gas lighter as a power source for an easy-to-manufacture curling device operable in a straightforward and safe manner.

Briefly stated, and according to an aspect of this invention, the foregoing objects are achieved by providing a curling device having a hollow handle adapted to receive and retain a gas lighter. When the gas lighter is inserted into the hollow of the handle of the curling device, it is retained in a "ready" or first position and is not actuated. When the user of the curling device desires to heat up the barrel of the curling device, the gas lighter is positioned into a second position. When urged into the second position, the valve actuating lever of the gas lighter is depressed and the flint wheel of the gas lighter is turned. A flame is thereby produced which heats the barrel of the curling device. When in the second position, a bi-metal member grips the cigarette lighter. The gas lighter is released when the temperature of the barrel exceeds a predetermined amount. In a preferred embodiment, the hair clip of the curling device cooperates with a trip member. When the user raises the hair clip, the bi-metal member releases its grip on the gas lighter. This prevents the curling device from being used while the gas lighter is activated.

BRIEF DESCRIPTION OF THE DRAWINGS

The invention both as to its organization and principles of operation, together with further objects and advantages thereof, may better be understood by referring to the following detailed description of an embodiment of the invention taken in conjunction with the accompanying drawings in which.

DESCRIPTION OF THE PREFERRED EMBODIMENT

Figure 1:
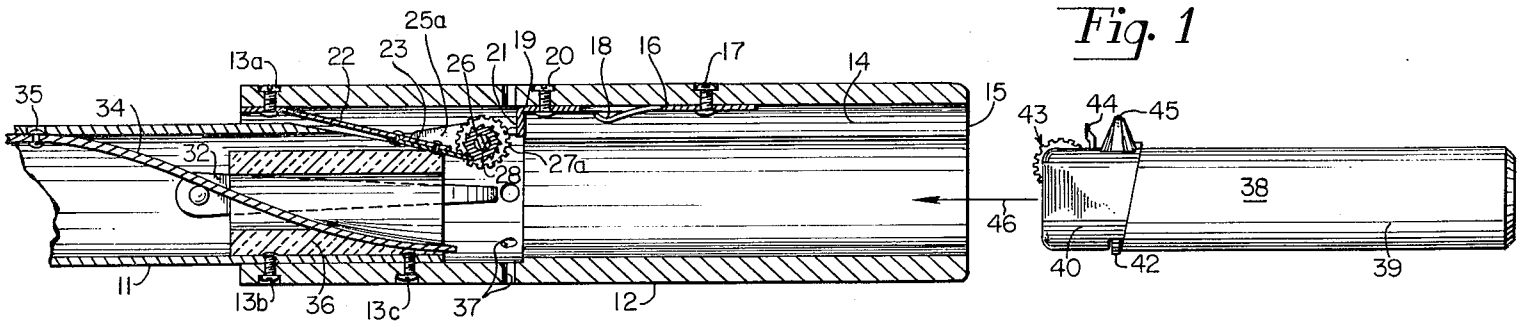
FIG. 1 is a side sectional view of a curling device and a side view of a gas lighter separate from the curling device, in accordance with this invention.

Referring now to FIG. 1, a curling device, such as a curling iron or styling wand, is made up of a heat conductive, generally cylindrical metallic barrel 11 secured to a first end of a generally cylindrical handle 12 by means such as screws 13*a*, 13*b* and 13*c*. The handle 12 is formed of a plastic or the like and defines an interior hollow portion 14 which is accessible through an opening 15 at a second end of the handle 12.

A retainer member 16 is connected to the handle 12 in the hollow portion 14 by means such as a screw 17. The retainer member 16 performs a biasing function and is comprised of a flexible material such as a metal or plastic. The end 18 of the retainer member 16 is cut out of, and bent from part of the retainer member 16 and forms a hump which acts as a stop in one direction by releasably retaining a companion gas lighter, in a manner to be described subsequently.

A valve activator 19 is connected to the handle 12 in the hollow portion 14, by means such as screw 20. A perpendicular extending portion 21 of the valve activator 19 protrudes into the hollow portion 14 of the handle 12. The extending portion 21 is used to activate the valve actuating lever, or the like, of an associated gas lighter in a manner to be described subsequently.

Figure 6:
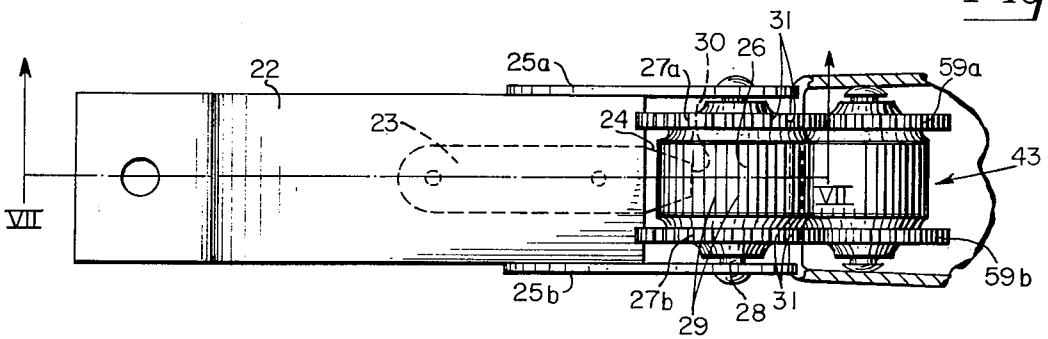
FIG. 6 is a top plan view of an actuating assembly, in accordance with this invention.

As best seen in FIG. 6, a support arm 22 extends downward into the hollow portion 14 of the handle 15. The support arm 22 is connected to the handle 12 by means such as screw 13*a*. A flexible member such as a ratchet spring 23 is connected to the free end of the arm 22 and includes a tapered end 24 extending from the free end of member 22. Also connected to the free end of the support arm 22 is support member 25*a* and 25*b*, which supports a flint wheel assembly.

The flint wheel assembly is made up of a flint wheel 26 and flint wheel guards 27*a* and 27*b* integrally attached to either side of the flint wheel 26. The flint wheel assembly is rotatably mounted on a shaft 28 which is connected to and supported by support members 27*a* and 27*b* in a manner well known in the art.

For the purpose of this invention, the utilization of a standard flint wheel assembly as described above is preferable from a cost effective and availability point of view. However, the flint wheel 26 may be replaced by a formed cylindrical member including a plurality of grooves 29 capable of engaging the tip portion 30 of the tapered end 24 of the ratchet spring 23. For example, a file having a plurality of parallel grooves would be a suitable substitute. Likewise, the flint wheel guards 27*a* and 27*b*, each with a plurality of meshing or gripping members such as teeth 31, may be separately assembled with the flat wheel. Other types of gripping members may be substituted providing it is capable of frictionally engaging the flint wheel assembly of a mating gas lighter.

Figure 4:
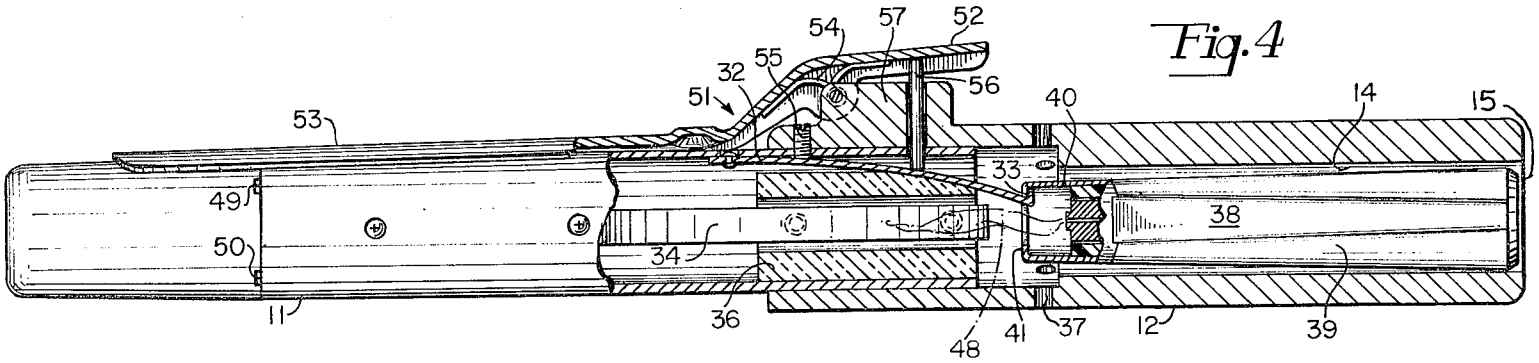
FIG. 4 is a side sectional view turned 90° with respect to FIG. 3 of the curling device and gas lighter inserted in the curling device in the second position, in accordance with this invention.

Best seen in FIG. 4 is a bi-metal member 32 attached to the inside of the barrel 11. The bi-metal member 32 is made up of a bi-metal material or materials well known in the art. Member 32 is attached to the inside of the barrel 11 in a manner in which it is thermally coupled to the hair winding portion of the barrel 11. The free end of the bi-metal 32 forms a gripping tip 33 best seen when referring to FIGS. 4 and 5. The function of the bi-metal member 32 will be described subsequently.

Figure 3:
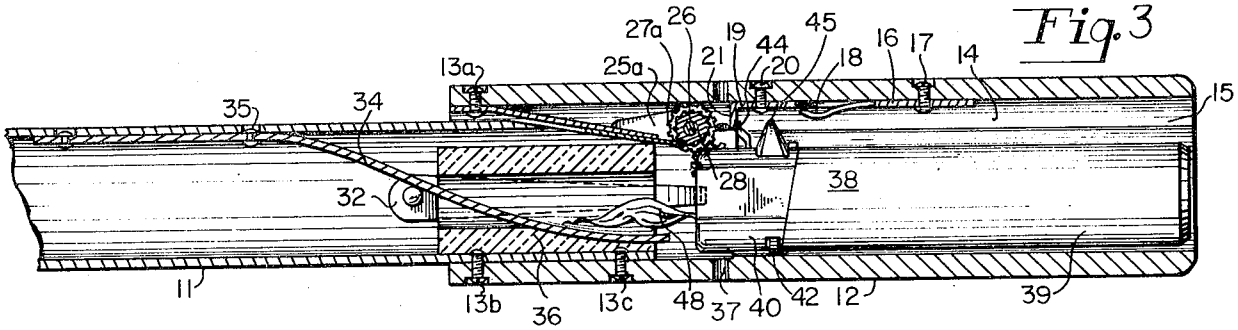
FIG. 3 is a side sectional view of the curling device and a side view of the gas lighter of FIG. 2 inserted in the curling device in a second position, in accordance with this invention.

Also included in the inside of the barrel 11 is a heat sink member 34 best shown in FIGS. 3 and 4. The heat sink member 34 is thermally connected to the barrel 11, at a first end, by means such as a rivet 35. The second end of the heat sink member 34 is disposed into the hollow portion 14 of the handle 12 so that the heat generated from the flame of the associated gas lighter can be readily conducted to the barrel 11. The composition of the heat sink member 34 is of any well known thermally conductive material.

In order to prevent unwanted heating of the handle 12, as well as to prevent false heating to the bi-metal member 32, the heat sink member 34 is surrounded by a flame resistant insulation member 36. Insulation member 36 is connected to the handle 12 by means well known in the art such as screws 13*b* and 13*c* shown in FIG. 1. A plurality of vent holes 37 are located in the handle 12 to insure that a sufficient quantity of air is introduced into the handle 12 to support combustion.

Referring now to the gas lighter of FIG. 1, a gas lighter referred to generally by numeral 38 is illustrated. The gas lighter 13 is powered by a combustable gas, such as butane, and its operation is well known in the art. The gas lighter 38 is preferably a disposable cigarette lighter, which is distributed widely. It will be obvious to those skilled in the art that the size and shape of the gas lighter 38 is to be generally compatible with the size and shape of the hollow portion 14 of the handle 12. Further, in a preferred embodiment, the gas lighter 38 is to be generally cylindrical and include a flame shield, flint wheel assembly, valve actuating lever and a lever stop.

The gas lighter 38 includes a plastic casing 39, such as formed of a plastic such as nylon, which may be injection molded. The working end of the casing 39 is connected, such as by a press fit, to a flame shield 40. The flame shield 40, seen in section in FIG. 4, typically contains a roll or bent portion 41, which is suitable for engagement with the gripping tip 33 of the bi-metal member 32, when the gas lighter 38 is in its operatable position with respect to the curling device. Disposed in an opening of the flame shield 40 is an adjustment wheel 42, which is not required for the practice of this invention.

Also disposed through an opening in the flame shield 40 is a flint wheel assembly 43 which will be discussed in greater detail when referring to FIG. 6. A valve actuating lever 44 is also included in the gas lighter 38. When the lever 44 is depressed by the thumb of the user or the like, a flow of vaporized fuel is initiated, in a manner well known in the art. A lever stop 45 is also provided to limit the travel of the valve actuating lever 44, all as well known in the art.

The gas lighter 38 is manually inserted through the openin 15 of the handle 12 into the hollow 14 in the direction indicated by arrow 46. The hollow 14 of the handle 12 and the shape and positioning of the components which interact with the gas lighter must be compatible to accommodate the type or types of gas lighters used as power sources for the curling device.

Figure 2:
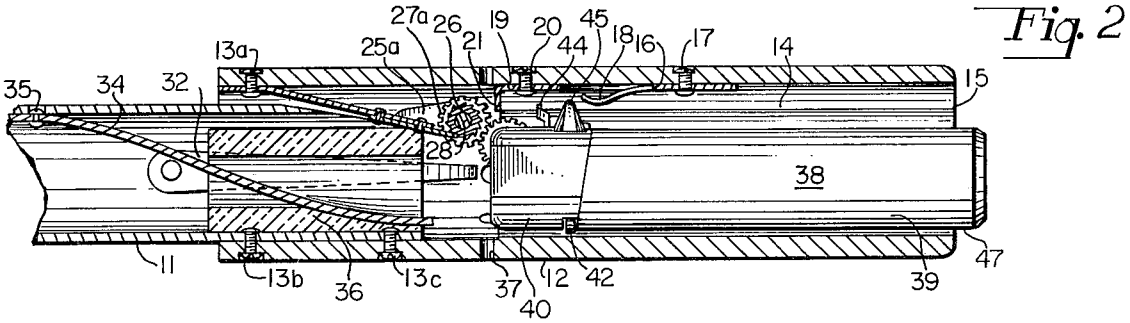
FIG. 2 is a side sectional view of the curling device with a side view of the gas lighter of FIG. 1 inserted in a first position in the curling device, in accordance with this invention.

Referring specifically to FIG. 2, the lighter 19 is shown inserted in a first position into the hollow 14, through opening 15, of handle 12. When the curling device is in an upright orientation, an abutment, such as the lever stop 45 interacts with the hump end 18 of the retainer member 16 and the retainer member 16 act as a one-way valve and prevent the gas lighter from falling out of the handle 12 when inserted past the hump end 18 of the retainer member 16. When in the first position, and if the curling device is moved in a normal manner, the gas lighter 38 is releasably retained in the handle 12 and will not fall out of the handle 12. To extract the gas lighter 38 from the handle 12 when the gas lighter 38 is in the first position (i.e. the lever stop 45 is beyond the end 18 of the retainer 16 but not yet coupled to the bi-metal member 32), a force is readily applied to a bottom portion 47 of the gas lighter 38 which extends from the second end of the handle 12.

In a preferred embodiment, the bottom portion 47 of the gas lighter 38 is displaced from the opening 15 of the handle 12. Such a displacement provides a gripping portion for the user to extract the gas lighter 38 from the handle 12 and also provides ease of positioning the gas lighter 38 into a second or activated position. Placing of the gas lighter 38 in the second or activated position may be provided by manually pushing the gas lighter 38 further into the hollow 14 in the direction of arrow 46, as shown in FIG. 1. Alternatively, the user can grip the outside of the handle 12 and force the bottom of the gas lighter 38 against a surface, such as a table, to position the gas lighter 38 further into the hollow 14 of handle 12.

FIG. 3 illustrates the gas lighter 38 in the second or activated position in the hollow 14 of the handle 12 of the curling device. In this arrangement, the portion 21 of the valve actuator 19 causes the valve actuating lever 44 of the gas lighter 38 to initiate fuel flow. Further, the flint wheel assembly attached to the arm 22 interacts with the flint wheel assembly 43 of the gas lighter 38 and causes the assembly 43 to rotate and strike a flint. The released vaporized fuel flow is thereby ignited and flame 49 occurs which transmits its heat through heat sink member 34 to the barrell 11. As the gas lighter 38 is urged from its first to second position, the lip 41 of the flame shield 40, or other convenient surface, is grasped by and held in place by the gripping tip 33 of the bi-metal member 32. Thus, as the gas lighter 38 is moved from its first to second position, gas flow is activated, the flint wheel is rotated and the lighter is held in place by the gripping tip 33 of the bi-metal member 32.

FIG. 4 illustrates a view of the gas lighter 38 engaged by the gripping tip 33 of the bi-metal member 32. Also shown in FIG. 4 is the general cylindrical barrel 11 with its vent holes 49 and 50. A hair clip member 51 is also shown which comprises a button portion 52 and a generally elongated portion 53. Portion 53 conforms to the generally cylindrical outer surface of the barrel 11, in a manner well known in the art. The hair clip member 51 is biased by a spring member 54 connected to a housing portion 57 to provide proper bias to the clip 53 when the button portion 52 is compressed, all as well known in the art. Also shown is a temperature adjustment screw 55, which biases the bi-metal member 32 in a manner to provide proper temperature control for the curling device.

A trip pin 56 is positioned through an aperture in housing portion 57. The trip pin 56 is positioned between the bi-metal member 32 and the underside of button portion 52 so that when the clip 51 is activated (when button portion 52 is pressed), the trip pin 56 causes a mechanical override of the bi-metal member 32. That is, the gripping tip 33 of the bi-metal member 32 releases its grip on the lip 41 of the flame shield 40.

Figure 5:
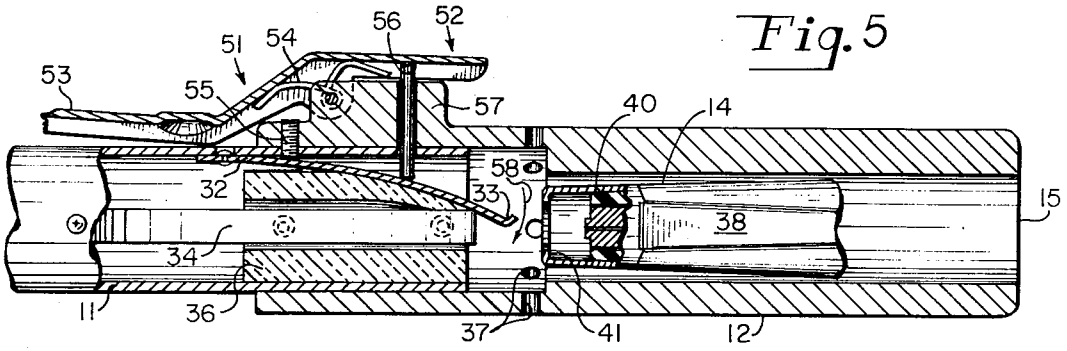
FIG. 5 is a side sectional view of the curling device of FIG. 4 with the gas lighter inserted in the curling device in the first position, in accordance with this invention.

Referring now to FIG. 5, the hair clip 51 is shown in its use position. The bi-metal member 32 at its gripping tip 41 is shown forced in the direction of arrow 58. When so forced, the grip of tip 41 is released from the flame shield 40 of gas lighter 38, and the gas lighter 38 is free to drop toward the opening 15 in the second end of the handle 12. In the preferred embodiment, the retainer 16 prevents the gas lighter 38 from falling out the opening 15 of handle 12. The bi-metal member 32 acts as a temperature control to the system in that its flexure or movement is calibrated by means of the temperature adjustment screw 55. When the temperature of the barrel 11 exceeds a predetermined amount, the amount of bending in the direction of arrow 58 of the bi-metal member 32 at gripping tip 41 will be sufficient to release the lighter 38.

In normal operation, when the temperature of the barrel 11 reaches its operating temperature, a color dot or the like indicates to the user that the curling device is ready for use. When the operating temperature is reached, the bi-metal member 32 releases the gas lighter 28. When the gas lighter is released from the second position, it will be allowed to fall to the first position. Only when the gas lighter 38 is in the second position is flame 48 present.

The trip pin 56 is provided as a safety measure. If the user chooses to operate the curling device before the barrel 11 reaches a temperature which will release the gas lighter 38 and thereby extinguish any flame, the trip pin 56 overrides the bi-metal member 32 and disengages the gas lighter 38 from the lip 41. Concomitantly the flame of the lighter is extinguished. The retainer member 16 prevents the lighter 38 from falling out the opening 15 of handle 12 until the gas lighter 38 is manually removed.

Referring now to FIG. 6, an enlarged view of the support arm 22, with its attached ratchet spring 23 and support members 25*a* and 25*b* for a flint wheel assembly, is shown, in the second position, in a meshed state with a like flint wheel assembly 43 of the gas lighter 38. Each flint wheel assembly is the same for the sake of simplicity. However, a member such as a file with a plurality of grooves capable of receiving tip 30 of tapered end 24 of ratchet spring 23 would suffice for the flint wheel 26 of arm 22. Likewise, any type of meshing means, which will drive the flint guard wheels 59*a* and 59*b* of the flint wheel assembly 43, will suffice for flint wheel guards 27*a* and 27*b*.

Figure 7:
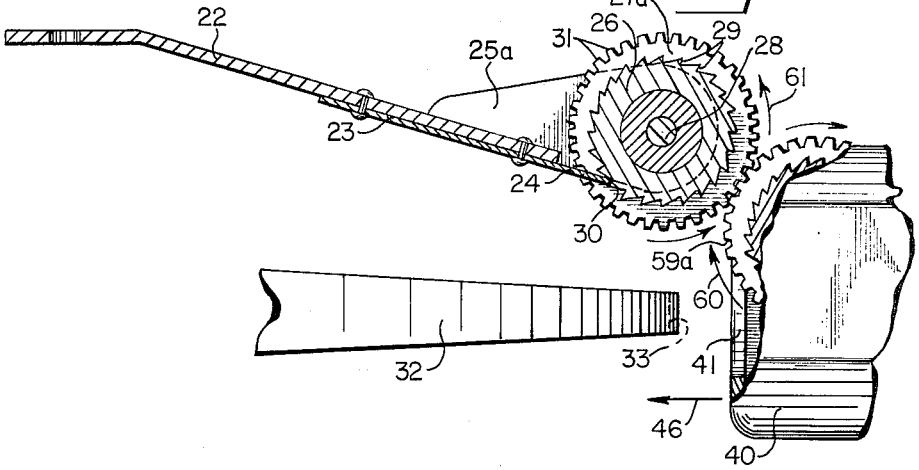
FIG. 7 is a side sectional view of the actuating assembly of FIG. 6 and the gas lighter, illustrating the gas lighter moving from the first to the second position, in accordance with this invention.

Referring now to FIG. 7, a view is shown in which the gas lighter 38 is being manually positioned from the first to the second position in the direction of arrow 46. Prior to the engagement of the lip 41 of the flame shield 40 to the gripping tip 33 of the bi-metal member 32, the guard wheels 59*a* and 59*b* of the flint wheel assembly 43 of the gas lighter 38 engage with the teeth 31 of the guard wheels 27*a* and 27*b*. After engagement of the respective flint wheel assemblies, and as the lighter 38 is being urged in the direction of arrow 46, the assembly 43 rotates in the direction of arrow 60 and ultimately causes flame 48 to act as a heat source for the curling device. The assembly attached to the arm 22 is prevented from rotating about its shaft 28 in a direction other than that indicated by arrow 61 due to the engagement of the tip 30 at tapered end 24 of spring 23 into a groove 29 of wheel 26.

Spring 23 provides sufficient force to the flint wheel 26 and thus guards 27*a* and 27*b* to assure that sufficient frictional force is realized to activate the friction wheel assembly 43 of the gas lighter 38. Further, spring 23 allows its flint wheel assembly to rotate freely about its shaft 28 in the direction opposite to that of arrow 46, such as when the bi-metal element 32 has released the lighter 38.

Figure 8:
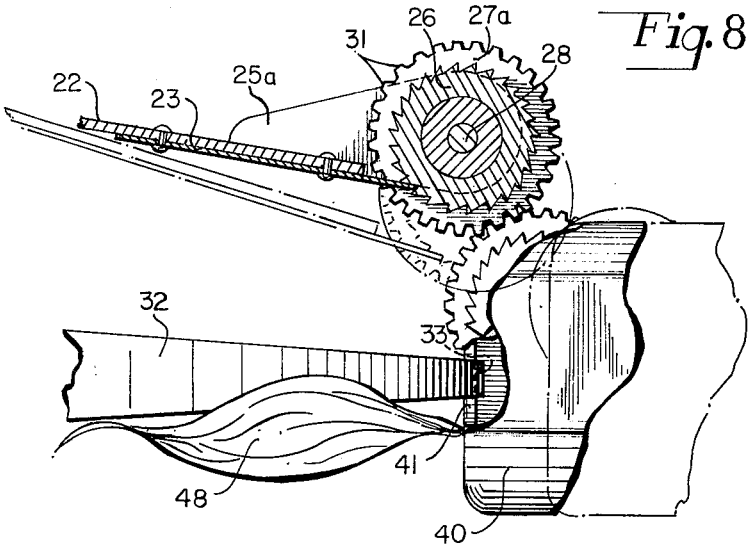
FIG. 8 is a side sectional view of the actuating assembly of FIG. 6 and the gas lighter in the second position, in accordance with this invention.

As best seen in FIG. 8 in solid lines, the flint wheel assembly of member 22 is in the second position pivoted toward the inner wall of handle 12 by the force of the gas lighter 38 moving in the direction of arrow 46 of FIG. 7 until the lip 41 of the flame shield 40 is engaged by the gripping tip 33 of the bi-metal member 32, and a flame 48 is realized. The solid lines of the flint wheel assembly of member 22 and its relationship to the gas lighter 38, also shown in solid lines, will remain as such until the bi-metal element 32 is either overridden by the trip pin 56 or the predetermined temperature of the barrel 11 is exceeded.

While an embodiment and application of this invention has been shown and described, it will be apparent to those skilled in the art that many more modifications are possible without departing from the inventive concepts herein described. For example, the bi-metal member may releasably grip the gas lighter at other than the lip of a flame shield. The invention, therefore, is not to be restricted except as necessary by the prior art and by the spirit of the appended claims.

What is claimed as new and desired to be secured by Letters Patent of the United States is:

1. A curling device adapted to be powered by a gas lighter having a valve actuating means and a flint wheel assembly, the curling device comprising:

a barrel having a hair winding portion disposed between first and second ends;

a hollow handle having a first end and a second end, said first end of said handle being connected to said second end of said barrel, said handle having an opening leading into said hollow of said handle, said hollow being of such a size that the gas lighter is capable of being inserted through said opening into said hollow of said handle;

biasing means for retaining the lighter in said hollow when the lighter is in a first position in said hollow and for releasing the lighter from said hollow through said opening when the lighter receives a predetermined force;

a bi-metal member thermally responsive to the temperature of said barrel and secured to said barrel, said bi-metal member having a gripping means adapted to engage the lighter when the lighter is in a second position in said hollow of said handle, when the temperature of said barrel exceeds a predetermined temperature, said gripping means of said bi-metal element releases engagement with the lighter;

means for activating the valve actuating means of the lighter when the lighter is in the second position; and flint wheel actuator means connected to the curling device and including a rotatable member having a grooved portion and a gripping portion, said flint wheel actuator means further including a flexible member adapted to engage said grooved portion of said rotatable member wherein the positioning of the lighter into the second position causes frictional engagement of the flint wheel assembly of the lighter with said gripping portion of said flint wheel actuation means thereby creating an ignition of the gas released by the valve actuating means of the lighter.

2. The curling device as in claim 1 further including a hair clip mounted on the curling device, said hair clip having a button portion, and a clip portion disposed along a length of said hair winding portion of said barrel; and a trip means mounted between said button portion and said bi-metal member, wherein a predetermined force provided to said button member to raise said clip portion from said hair winding portion causes said gripping means of said bi-metal member to be positioned to disengage the lighter.

3. The curling device as in claim 2 wherein said opening of said handle is at said second end of said handle and wherein said length of said hollow handle and the length of the lighter is such that a portion of the lighter extends beyond said opening at said second end of said handle when the lighter is in the first position in said handle, wherein a force applied to the bottom of the lighter will cause the lighter to move from the first position to the second position in said hollow of said handle.

* * * * *